United States Patent [19]

Molenda

[11] Patent Number: 4,842,303

[45] Date of Patent: Jun. 27, 1989

[54] REPOSITIONABLE ADVERTISING INSERT

[75] Inventor: Robert P. Molenda, Grant Township, Washington County, Minn.

[73] Assignee: Minnesota Mining and Manufacturing Company, Saint Paul, Minn.

[21] Appl. No.: 77,599

[22] Filed: Jul. 23, 1987

[51] Int. Cl.[4] ..... B42D 1/00; B42D 1/10; B42D 5/00; G09F 19/00

[52] U.S. Cl. ..... 281/38; 281/2; 281/15.1; 40/530

[58] Field of Search ..... 281/1, 2, 9, 23, 13, 281/21, 38, 17, 3 A, 4, 5, 38, 15 R; 283/61, 62, 1 R, 56; 229/70, 73, 92.8; 40/530; 428/40

[56] References Cited

U.S. PATENT DOCUMENTS

| | | | |
|---|---|---|---|
| 676,857 | 6/1901 | White | 281/15 R |
| 683,632 | 10/1901 | Wright | 40/530 |
| 1,161,580 | 11/1915 | Allen | 40/530 |
| 1,478,130 | 12/1923 | Marsh | 281/5 |
| 1,835,909 | 12/1931 | Shoemaker, Jr. | 281/15 R |
| 2,755,576 | 7/1956 | Golden | 281/15 R |
| 3,275,316 | 9/1966 | Cleary, Jr. | 281/2 |
| 3,794,550 | 2/1974 | Taillie | 281/38 |
| 4,288,935 | 9/1981 | Cross | 40/530 |
| 4,500,021 | 2/1985 | Bildusas | 428/40 |
| 4,685,699 | 8/1987 | Hirasawa | 281/15 R |

FOREIGN PATENT DOCUMENTS

| | | | |
|---|---|---|---|
| 2543064 | 9/1984 | France | 281/1 |

*Primary Examiner*—Frank T. Yost
*Assistant Examiner*—Paul M. Heyrana, Sr.
*Attorney, Agent, or Firm*—Donald M. Sell; Walter N. Kirn; John C. Barnes

[57] ABSTRACT

An advertising insert for ad signatures in magazines is convenient when comprised of a readily peelable and adhesively repositionable sheet bearing a coupon, phone number or the like which is part of a backer which can be removed along perforations from an edge adhered to the ad signature.

20 Claims, 4 Drawing Sheets

REPOSITIONABLE ADVERTISING INSERT

BACKGROUND OF THE INVENTION

1. Field of the Invention

This invention relates to an improved advertising insert which provides a product coupon or a reminder sheet together with a instant response card such as a return card which may be mailed back to the advertiser, and in one aspect, to a new magazine advertising insert with a removable, repositionable information piece and a support member for that piece on an advertising signature.

2. Description of the Prior Art

Mailers or return cards or instant response cards which have been inserted in magazines are well known. These cards are usually of card stock sufficient to meet the specifications for the United States mails and which are joined along a fold line to separate the mail or return card from the advertising piece and the fold permits the same to be bound with the signatures in the magazine at the bindery. To promote the Post-it TM note pads, during the early days of their introduction, pads with as few as ten sheets had been placed on an advertising sheet to provide a physical sample of the product to the consumer at the time of purchase of the advertising sheet or a magazine bearing the advertising sheet. The sheets in the pad were adhered by the adhesive band along an edge perpendicular to the binding edge with the back sheet permanently glued to the page.

Further, it has been known prior to the present invention to print recipes on one surface of a sheet of paper having a repositionable pressure sensitive adhesive coated along one edge of the opposite side of the sheet and attaching the printed sheet by said adhesive direct on an advertising page. The edge bearing the adhesive was perpendicular to the binding edge. Such a program was offered for sale to a company commercializing baking products more than a year prior to the filing date of this application.

The present invention however, is concerned with an advertising insert comprising a printed sheet and a support sheet therefor which support sheet is readily adapted to be a printed return card or instant response card and thus could have the proper size and weight for mailing. This support card, which will be referred to hereafter as the backer, has adhered to one face thereof the printed sheet of paper stock having a narrow band of repositionable pressure sensitive adhesive coated along one edge to adhere the paper stock in registry with one edge of the backer. Thus, the pressure sensitive adhesive coated printed sheet provides a product coupon, recipe, directions, phone numbers, reminders or other graphics or indicia, which is removable from the magazine, adapting the same to be positioned as desired by the user and the backer is preferably provided with a perforated edge adjacent a spot or two of permanent adhesive which binds the backer to a page of an advertising signature.

That invention thus differs also from an advertising piece prepared by 3M Deutschland GmbH, Postfach 100422, 4040 Neuss, West Germany, which piece included an eight page little booklet which was adhered by a permanent adhesive to a cover page of a Post-it TM note pad advertisement wherein the back sheet of the booklet was adhered by a permanent adhesive to the cover page of the advertisement and was of relatively stiff material bearing a return address for 3M Deutschland GmbH, and within the booklet between said back sheet and a cover sheet, on page 3, was adhered a plurality of sheets of yellow paper positioned in a stack. Each sheet had a repositionable pressure sensitive adhesive coated on one surface along one marginal edge positioned in register and aligned with the free edge of the page such that a pad was formed from the sheets and the pad was adhered to page 3 of this booklet. The advertisement was primarily to attract attention to the repositionable yellow note sheets. The front cover of this booklet which was adhered to the page had printing corresponding to the printed page such that the booklet was registered with the printing on the page and the cover of the booklet appeared to be a continuation of the printed page at first glance. The booklet was positioned with the bound edge of the booklet generally parallel to the binding edge of the advertising page. The bound or common edge of the booklet was spaced from the binding edge of the advertising page.

The present invention differs from these prior art forms in that a laminate of a support sheet, the backer, and at least one repositionable sheet of paper, due to the coating on one surface thereof of the narrow band of low-tack pressure sensitive adhesive, provides an advertising insert which may be readily placed by existing equipment in a bindery on any printed advertising page and adhered thereto by conventional means such as a hot melt adhesive or a cold glue to secure the same to the sheet and there is no pressure sensitive adhesive exposed which can interfere with the handling of these laminates at the bindery which are generally of a size on the order of 9 cm×13 cm (3.5×5 inches). The position of the pressure sensitive adhesive coated edge assures trouble-free handling at the bindery.

The insert of the present invention also provides an attention-gathering advertising insert which is readily adapted to the advertising market for magazines to aid in getting information to the consumer in a form which will be readily usable by the consumer.

The features of this invention will be further described below.

SUMMARY OF THE INVENTION

The present invention relates to a repositionable advertising insert comprising a printed support sheet or backer which has a registration edge which is to be aligned with the binding edge of a page of advertising and has adjacent that edge a parallel perforation along a line permitting separation of the support sheet at the perforations, and a printed sheet of paper stock having opposite surfaces and a narrow band of repositionable pressure sensitive adhesive coated on one surface of the page adjacent an edge to bind the sheet of paper stock to the backer adjacent the registration edge thereof.

The backer and the printed sheet of paper stock may have various dimensions but it is preferable that the support member have dimensions between the perforations and the other marginal edges to make it suitable for mailing and thus it must exceed the minimal dimensions for material acceptable to the postal service. Thus the backer can function as a return card or instant response card which the consumer could merely tear from the magazine along the perforation and place in the mails. The printed sheet of paper stock with the coating of repositionable pressure sensitive adhesive can be readily peeled from the magazine by peeling the sheet from the backer adjacent the registration edge thereof. This printed sheet of paper stock may serve as a discount coupon, it may bear indicia providing a recipe, a reminder note, a list, a memorandum, or other notice which the reader may desire to remove from the magazine and attach in a more convenient or desirable place. This sheet of paper stock could also be provided with a score line or perforations along a line parallel to the line registering the same with the backer. Such score line allows ease in folding to cover the adhesive or the perforation allows removal of the adhesive coated edge portion.

The repositionable advertising insert is adapted to be attached to an advertising page or one page of an advertising signature adapted to be sent to a magazine bindery where the signatures are combined with other printed signatures of the magazine and collated, bound, sorted, labeled and mailed.

BRIEF DESCRIPTION OF THE DRAWING

The present invention will be further described with reference to the accompanying drawing wherein.

DETAILED DESCRIPTION

Figure 1:
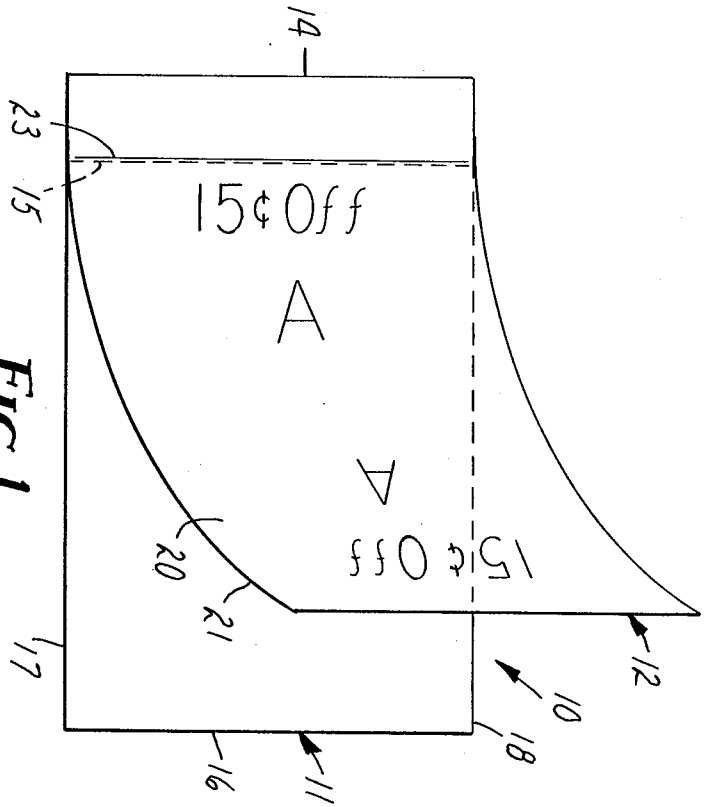
FIG. 1 is a perspective view of a repositionable advertising insert according to the present invention showing a backer and repositionable sheet with the sheet lifted along one edge and partially peeled from the backer to illustrate the backer.

Referring now to the drawing, and particularly to FIG. 1, a repositionable advertising insert generally designated 10 is illustrated. The insert comprises a printed support sheet or backer 11 and a printed sheet 12 of paper stock.

The backer 11 comprises a sheet of material which may be adhered onto a support sheet or page of a signature of an advertising insert for a magazine. The sheet 11 is preferably formed of a card stock having a stiffness acceptable for the postal service, and it would have generally a size acceptable for mailing as a post card in the mail system. Such material is on the order of 9 cm×13 cm and at least 10 pound bond to 20 point box board. This backer 11 is printed on one surface with an address of the recipient such as the advertiser. On the other surface may be printed an order form, a contest entry form, or other request for information. The backer 11 is provided with a registration edge 14. Parallel to and spaced from the registration edge 14 is a line 15 which is perforated and printed, most likely, to indicate the position of the perforations. The perforated line 15 permits the backer 11 to be torn along the perforated line such that the portion of the backer between the perforated line 15 and the edge 16 opposite the registration edge may be separated from the advertisement. The size of the backer 11 between the perforated line 15, the edge 16, and the ends 17 and 18 preferably have the dimensions of 9 cm×13 cm or greater, to permit that separated portion to be passed through the postal system. The sheet 12 is a printed sheet which may bear a product coupon from the advertiser permitting a discount on the purchase of that product, or other graphics or indicia such as recipes, directions or phone numbers, reminders, lists, etc. which one can easily separate from the backer by peeling the same from the backer and then the sheet 12 may be adhered to the refrigerator or other convenient location. The sheet 12 has an outer printed surface 20 and an under surface 21 which may or may not be printed. Adjacent one edge of the surface 21 however is coated a layer of repositionable pressure sensitive adhesive. This is an adhesive having lower tack and an adhesive which permits the same to be adhered to another document and separated without any deleterious effect on the other document. An example of the adhesive material is a pressure sensitive repositionable acrylate copolymer adhesive, as described in U.S. Pat. No. 3,691,140, assigned to the assignee of this application. This adhesive is generally coated on the sheet 12 of paper stock adjacent the edge in a narrow band having a width of 6 to 19 mm.

Figure 2:
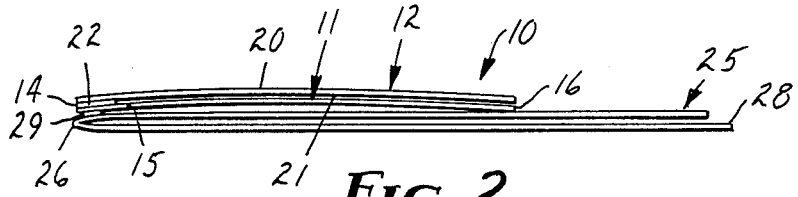
FIG. 2 is a end view of an advertising signature with the insert adhered thereto.
Figure 3:
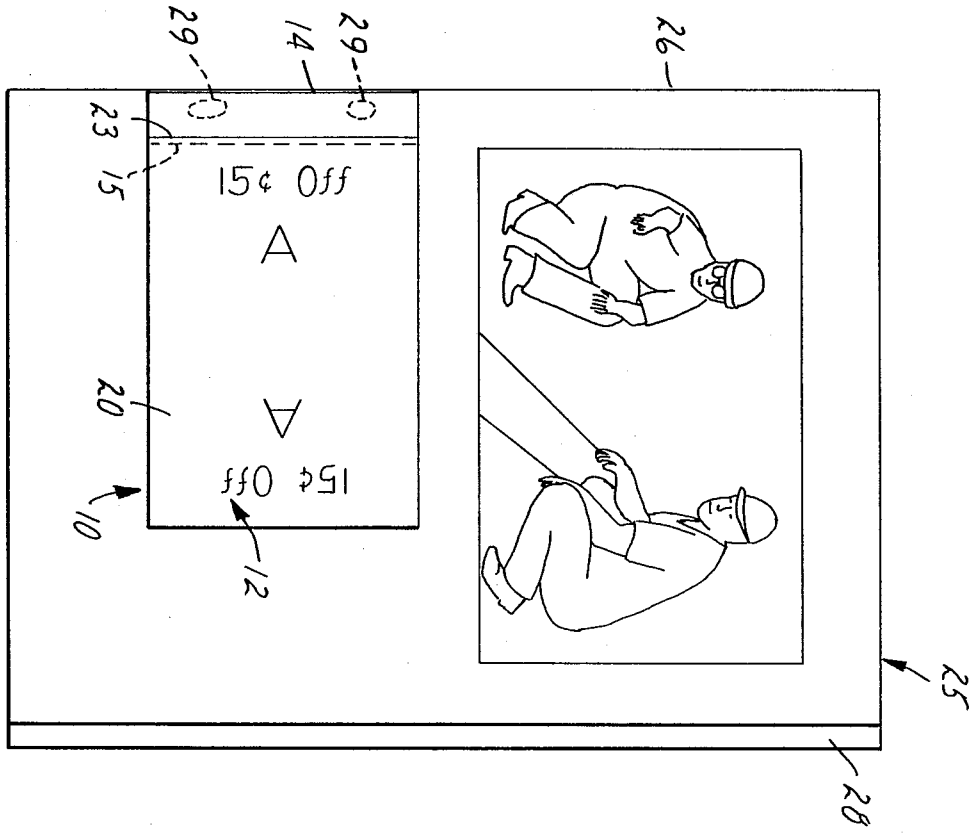
FIG. 3 is a plan view of the signature of FIG. 2 with a repositionable advertising insert ready for binding.

Referring now to FIGS. 2 and 3 there is illustrated the repositionable advertising insert 10 positioned on top of one page of an advertising signature 25 having four pages, i.e. the top page, the opposite inside page, the juxtapositioned page on the back side, and the rear page. The four signature pages are printed on a single sheet which is folded at 26. Normally in forming an advertising signature for delivery to the bindery the sheet is not folded exactly in the middle to provide a marginal edge 28 along which distribution instructions for the signature are provided to the bindery. The backer 11 is adhered to the signature 25 by two spots of hot melt adhesive 29. The spots of adhesive 29 are positioned more nearly the registration edge 14 of the backer 11 than the line of perforations 15. The sheet of paper stock 12 is shown adhered to the backer 11 by the narrow band of adhesive 22 which is positioned between the edge 24 of the sheet 12 and the printed line or scored line 23.

Figure 4:
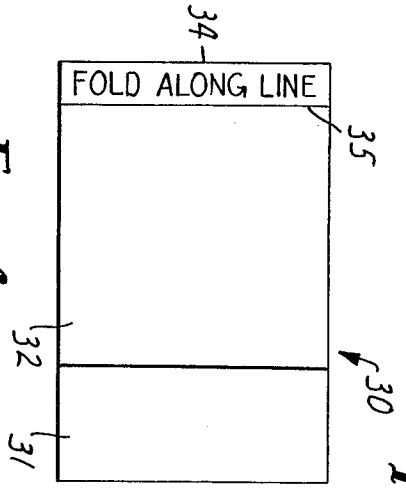
FIG. 4 is a plan view of a further embodiment of the repositionable advertising insert.

Referring now to FIG. 4 there is shown an alternative embodiment of the repositionable advertising insert. In this embodiment, designated by the reference numeral 30, there is a backer 31 and a sheet 32 of paper stock which is provided with a coating of repositionable adhesive on the inner surface of the sheet between a marginal registration edge 34 and a printed fold line 35. It will noted however that the sheet 32 has a dimension shorter than the backer 31 in a direction perpendicular to the marginal edge 34. This illustrates that the adhesively coated removable sheet 32 may have a dimension less than that of the backer 31.

Figure 5:
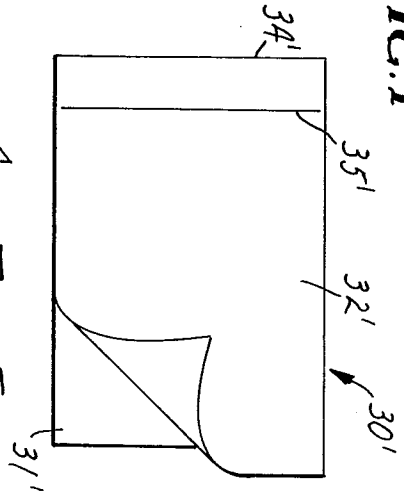
FIG. 5 is a perspective view of a further embodiment of the repositionable advertising insert.

Referring now to FIG. 5 there is illustrated a further embodiment of the repositionable advertising insert 30' wherein like parts have the same reference numeral except the backer 31' has a dimension perpendicular to the marginal edge 34' which is less than the same dimension for the sheet 32'.

Figure 6:
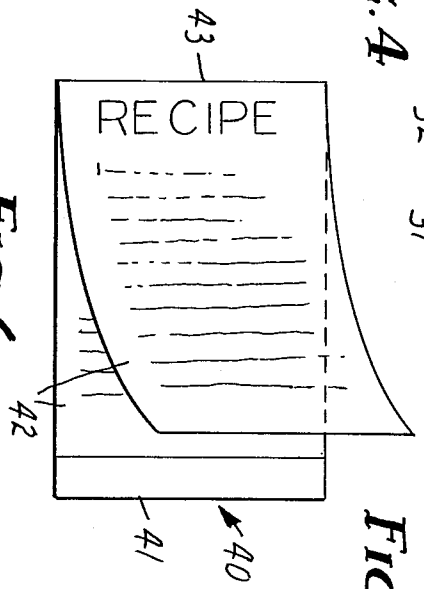
FIG. 6 is a perspective view of a further embodiment of the advertising insert.

In FIG. 6 the repositionable advertising insert is generally designated 40 and comprises a backer 41 having a dimension perpendicular to a registration edge 43 thereof which is longer than the corresponding dimension of the sheet 42 of paper coated with the repositionable adhesive and adhered to the backer 41 adjacent the marginal edge 43. Further, the embodiment of FIG. 6 illustrates that a plurality of sheets 42 may be positioned in registry on top of one another, each of which are coated with a repositionable pressure sensitive adhesive and stacked on the backer 41 with the edges adjacent the narrow band of adhesive aligned with the marginal registration edge 43 of the backer 41.

Figure 7:
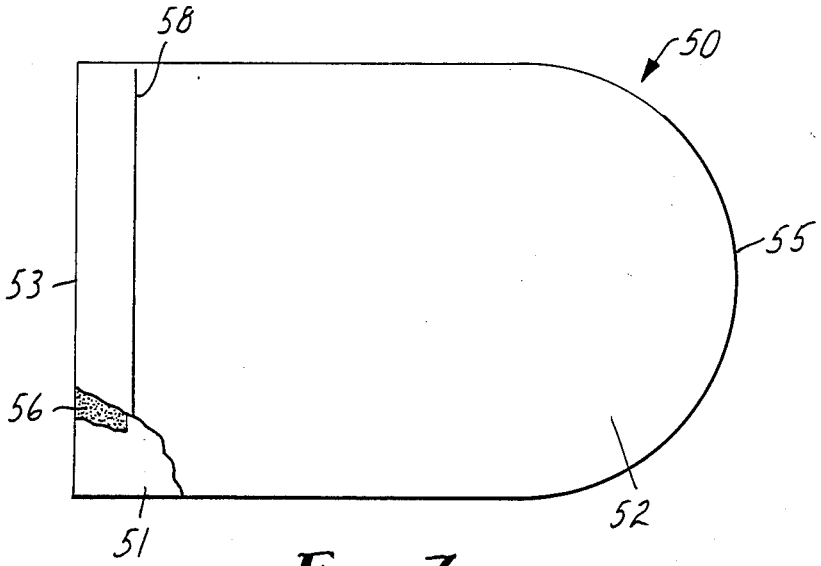
FIG. 7 is a plan view, with portions broken away of a further embodiment of the advertising insert.

FIG. 7 illustrates a further embodiment of a repositionable advertising insert generally designated 50 wherein the backer 51 and sheet of paper stock 52 are of the same size and positioned with the sheet 52 adhered by a narrow band of pressure sensitive adhesive 56 to the backer 51 with the marginal edge 53 of the sheet 52 aligned with the registration edge of the backer. The backer and the sheet 52 have an edge opposite the registration edge 53 which are identical and formed irregularly with at least a portion being arcuate as iluustrated by the edge 55 to provide a more aesthetic advertising insert and one which readily gains attention of the reader. Other irregular edges may be die cut in the advertising insert to provide some attention-receiving characteristics other than that illustrated.

Figure 8:
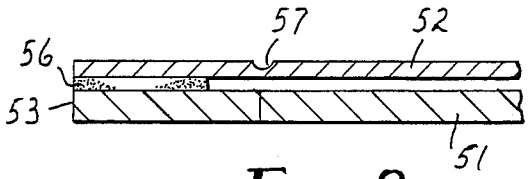
FIG. 8 is an enlarged detail sectional view of an advertising insert according to the present invention.

To afford greater ease in folding the sheet 52, there is illustrated in FIG. 8 that the sheet 52 is scored as at 57 along the printed line 58. This provides a line about which the sheet 52 may be readily folded to fold the narrow band of pressure sensitive adhesive 56 on the sheet 52 against the back of the sheet 52 after the same has been peeled from the backer 51. The scoring may also be formed such that the narrow band between the printed line 58 and the registration edge 53 may be readily separated.

The purpose of the repositionable pressure sensitive adhesive 56 however is to permit the reader to remove the sheet 52 from the backer 51 and position the same on a coupon book or on a refrigerator or shopping list such that the same is always readily available for use.

Figure 9:
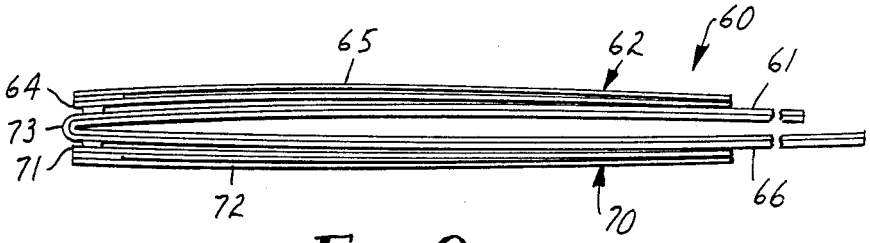
FIG. 9 is another end view of an advertising signature having a repositionable advertising insert adhered to both of the outer pages.

Referring now to FIG. 9 there is illustrated a signature 60 having eight pages. Adhered to the outer page 61 is a repositionable advertising insert 62 comprising a backer 64 and a repositionable adhesively attached sheet 65. On the opposite or back page 66 of the same signature 60 is a second repositionable advertising insert 70 having a backer 71 and a repositionable printed sheet 72. Existing equipment at the bindery may apply spots of hot melt adhesive to the backer adjacent the marginal edges and then position the same on top or to the back of the signatures. The equipment will readily align the registration edge of the backers with the binding edge 73 of the signature 60. It is preferred that the registration edge of the backers be parallel to but slightly spaced from the registration edge 73.

Figure 10:
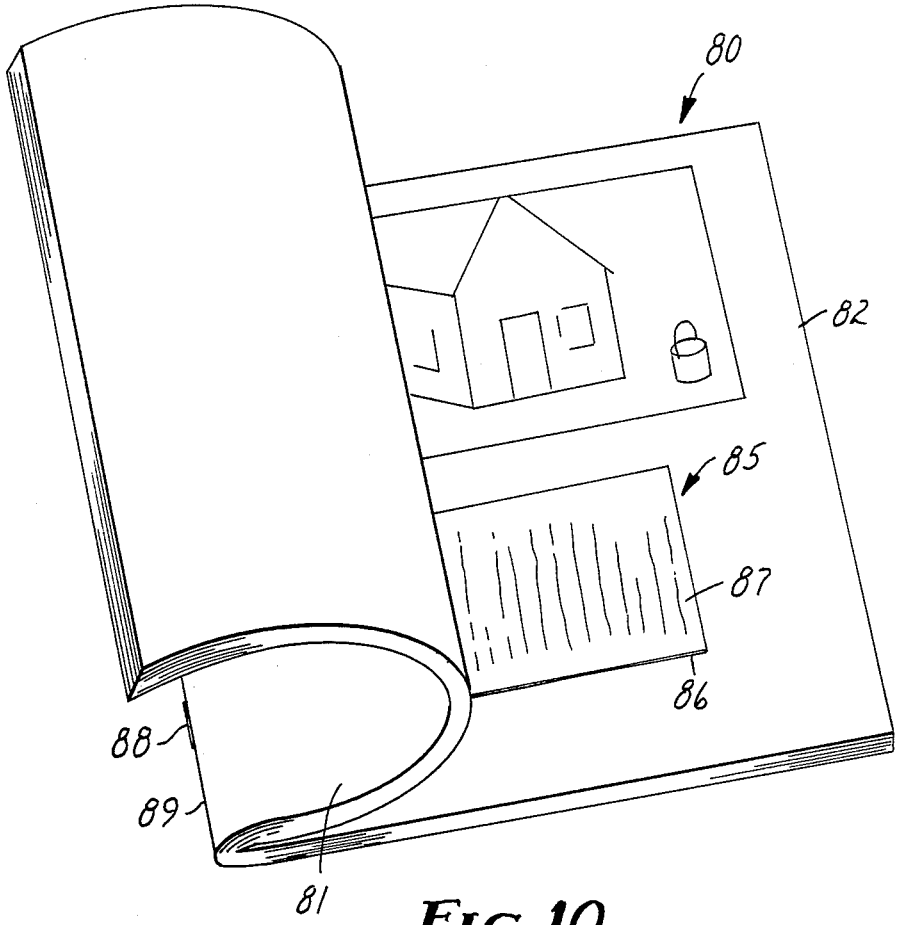
FIG. 10 is a perspective view of a magazine including the repositionable advertising insert on an advertising signature bound in the magazine.

Referring now to FIG. 10 there is shown a magazine 80 comprising a cover 81 which is bound around a plurality of signatures all of which are positioned in registry and then bound along the binding edge by means of saddle stitching or stapling. A magazine which is stapled has all of the signatures positioned over a saddle and the cover positioned over the signatures and two staples, one of which is illustrated at 88, positioned in spaced relation along the binding edge 89 hold the magazine together. In this magazine 80 you will notice it is opened to a page 82 of advertising. On this page is a repositionable advertising insert 85 comprising a backer 86 and a repositionable adhesively coated printed sheet 87. Thus the reader of this magazine, rather than tearing a return card which might have been inserted in the magazine and stapled along the binding edge, may peel out the sheet 87 from the backer 86 and place the same at some convenient location. The reader could then remove the backer 86 along a perforated line and complete the card and mail the same back to the advertiser.

Figure 11:
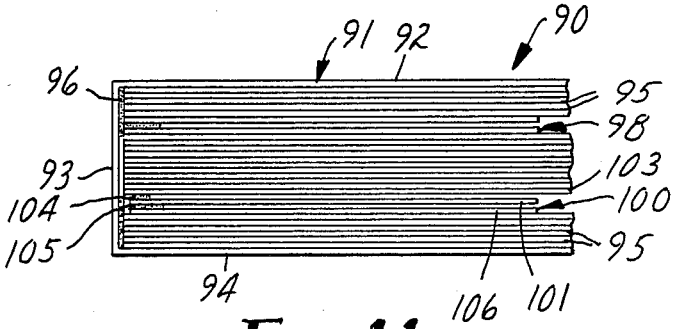
FIG. 11 is an enlarged fragmentary end view of an alternative magazine structure.

In FIG. 11 an enlarged fragmentary end view of a magazine 90 is illustrated. The magazine comprises a continuous cover 91 having a cover portion 92, a binding edge or spine 93 and back portion 94. The pages 95 of the magazine are adhered to the inner surface of the spine 93 by an adhesive material 96. A repositionable advertising insert 98 is positioned between two pages and the registration edge of the insert 98 which corresponds to the insert 10 or 50 is adhered to the spine by the adhesive 96. A second advertising insert 100 is illustrated wherein the backer 101 is adhered to an outside page 103 of an advertising signature by a permanent adhesive 104, similar to the adhesive spots 29, and the registration edge is parallel but spaced from the bound edge of the page 103. The repositionable pressure sensitive adhesive 105 on the printed sheet of paper stock 106 releasably binds the sheet 106 to the backer 101. Such an adhesive binding, using hot melts or other adhesvies such as a pressure sensitive or cold adhesive, for magazines is commonly referred to as "perfect" binding.

Having thus described the present invention with respect to a preferred embodiment and several modifications thereof it will be appreciated that additional modifications can be made without departing from the spirit or scope of the invention as claimed herein.

I claim:

1. A repositionable advertising insert comprising:

a printed support sheet having a registration edge, and a printed sheet of paper stock having on one surface along one edge a narrow band of repositionable pressure sensitive adhesive, said edge along which said band of pressure sensitive adhesive is coated being aligned with said registration edge of said support sheet, and said layer of pressure sensitive adhesive bonding said sheet of paper stock to said support sheet, said suport sheet being perforated along a line parallel to said registration edge and adjacent said band of pressure sensitive adhesive.

2. A repositionable advertising insert according to claim 1 wherein said support sheet and said sheet of paper stock have different dimensions in a direction perpendicular to said registration edge of said support sheet.

3. A repositionable advertising insert according to claim 1 wherein a plurality of printed sheets of paper stock having said narrow band of repositionable pressure sensitive adhesive coated along said one edge are placed in register with said support sheet.

4. A repositionable advertising insert according to claim 1 wherein said support sheet and said sheet of paper stock are of the same size.

5. A repositionable advertising insert according to claim 4 wherein the edge of said support sheet and the edge of said sheet of paper stock opposite said registration edge have an irregular shape to gain attention to the insert.

6. A repositionable advertising insert according to claim 5 wherein said edge of irregular shape includes at least one arcuate edge portion.

7. A repositionable advertising insert according to claim 1 insert wherein said sheet of paper stock is scored along a line spaced from said registration edge a distance equal to the width of said band of adhesive.

8. A repositionable advertising insert according to claim 7 wherein a line is printed on the surface of the sheet of paper stock parallel to the registration edge of said support sheet and spaced therefrom a distance at least equal to the width of said band of repositionable pressure sensitive adhesive and instructions are printed between said registration edge and said printed line requesting that the sheet of paper stock be folded along said line.

9. A repositionable advertising according to claim 1 insert wherein said support sheet has one surface thereof attached by an adhesive to a printed sheet.

10. A signature of advertising material comprising a plurality of pages joined along a fold line defining a binding edge, a support sheet having a registration edge and an opposite edge joined by parallel side edges, one surface of the support sheet being joined by a permanent adhesive to an outside page of said signature with said registration edge parallel to and closer to said binding edge than said opposite edge, and a printed sheet of paper stock printed on one or both surfaces, said sheet of paper stock having an edge aligned with said registration edge of said support sheet and having a narrow band of repositionable pressure sensitive adhesive coated on a surface adjacent said support sheet parallel to said registration edge, said band of repositionable pressure sensitive adhesive bonding said printed sheet to said support sheet adjacent said registration edge.

11. An advertising signature according to claim 10 wherein said support sheet and said printed sheet have different dimensions in a direction perpendicular to said registration edge of said support sheet.

12. An advertising signature according to claim 10 wherein said registration edge is closely adjacent said binding edge of said pages of said signature.

13. An advertising signature according to claim 10 wherein said support sheet and said printed sheet have corresponding dimensions.

14. An advertising signature according to claim 10 wherein the edges of said support sheet and said sheet of paper stock opposite said registration edge have an irregularity for attracting attention to the support sheet and to said printed sheet.

15. An advertising signature according to claim 10 wherein said support sheet is adhered to said outside page of said signature by adhesive adjacent said registration edge and said support sheet is perforated along a line spaced from said registration edge a distance to be free of said permanent adhesive.

16. A magazine comprising a cover and a plurality of pages disposed with the binding edges of the pages aligned and bound to said cover, a printed backer having a registration edge positioned parallel to the binding edges of said pages and disposed between two pages, and at least one printed sheet of paper stock having opposite surfaces and having on one surface adjacent one edge of narrow band of repositionable pressure sensitive adhesive, said band of repositional pressure sensitive adhesive bonding the sheet of paper stock to one surface of said backer with the registration edge of the backer and said one edge of said sheet of paper stock aligned.

17. A magazine according to claim 16 wherein said backer and said sheet of paper stock have different dimensions in a direction perpendicular to said registration edge of said backer.

18. A magazine according to claim 17 wherein said backer and said sheet of paper stock have corresponding dimensions.

19. A magazine according to claim 16 wherein the edges of said backer and said sheet of paper stock opposite said registration edge have an irregularity for attracting attention to the backer and to the sheet of paper stock.

20. A magazine according to claim 16 wherein the pages include at least one advertising signature comprising at least four pages and said backer is bound to an outside page of said signature with the registration edge adjacent the binding edge of said signature.

* * * * *